US005256214A

United States Patent [19]

Ashok

[11] Patent Number: 5,256,214

[45] Date of Patent: Oct. 26, 1993

[54] COPPER ALLOYS AND METHOD OF MANUFACTURE THEREOF

[75] Inventor: Sankaranarayanan Ashok, Bethany, Conn.

[73] Assignee: Olin Corporation, Cheshire, Conn.

[21] Appl. No.: 896,523

[22] Filed: Jun. 10, 1992

Related U.S. Application Data

[62] Division of Ser. No. 606,393, Oct. 31, 1990.

[51] Int. Cl.[5] ..... C22C 9/00

[52] U.S. Cl. ..... 148/411; 148/414; 420/487

[58] Field of Search ..... 148/411, 414, 432, 435; 420/487, 488

[56] References Cited

U.S. PATENT DOCUMENTS 4,569,702 2/1986 Ashok et al. ..... 148/435

5,104,748 4/1992 Mori et al. ..... 148/414

*Primary Examiner*—George Wyszomierski

*Attorney, Agent, or Firm*—Bruce E. Burdick

[57] ABSTRACT

A method for the manufacture of a copper based alloy and the alloy produced thereby having improved mechanical properties. An alloy containing a dispersoid ingredient and a precipitating ingredient are spray cast so that during spray casting the dispersoid ingredient forms a second phase as a uniform dispersion of relatively small dispersoids. After solution treating and aging, the solid state precipitating ingredient precipitates as a third phase of a solid state precipitate.

2 Claims, 2 Drawing Sheets

COPPER ALLOYS AND METHOD OF MANUFACTURE THEREOF

This application is a division of application Ser. No. 07/606,393, filed Oct. 31, 1990.

CROSS-REFERENCE TO RELATED APPLICATION

This application is related to co-pending U.S. patent application Ser. No. 385,034, entitled "COPPER ALLOYS HAVING IMPROVED SOFTENING RESISTANCE AND A METHOD OF MANUFACTURE THEREOF" by Sankaranarayanan Ashok, filed Jul. 26, 1989.

BACKGROUND OF THE INVENIION

1. Field of the Invention

The present invention relates to copper alloys having improved properties and more particularly, the invention relates to spray cast alloys having a uniformly dispersed second phase and a solid state precipitate.

2. Background Information

Copper based alloys are widely used for electronic, electrical, and thermal applications. Electrical connectors and leadframes are usually formed from copper alloys to exploit the high electrical conductivity inherent in the alloys. Heat sinks, heat exchanger coils, and cooling fins are also manufactured from copper based alloys to take advantage of the excellent thermal conductivity of the alloys.

The copper based alloys are often cold worked following casting to increase the strength of the alloy. When exposed to elevated temperatures, the alloys recrystallize. Recrystallization is accompanied by a loss of structural strength. This phenomenon is often expressed in terms of softening resistance. Softening resistance is a measure of the ability of an alloy to resist deformation when exposed to elevated temperatures. It is desirable to fashion a copper based alloy having high thermal conductivity and high electrical conductivity which also resists softening at elevated temperatures.

A method of manufacturing such copper alloys having improved softening resistance is disclosed in copending U.S. application Ser. No. 385,034, filed Jul. 26, 1989. According to that method, spray casting is used to produce an alloy having a second phase of dispersoid uniformly dispersed throughout a matrix of a copper based alloy. It has been found that alloys produced in accordance with this application also have improved stress relaxation. Stress relaxation is defined as a loss of stress while at a constant strain.

In addition to improved softening resistance and stress relaxation, it is also desirable that alloys for certain electrical and electronic properties have good mechanical properties. In certain applications, the alloys are subjected to applications in which mechanical failure may be a problem. Accordingly, it is desirable that such alloys have good tensile strength, yield strength, and good bending properties.

SUMMARY OF THE INVENTION

In accordance with the invention, a copper alloy containing a dispersoid ingredient and an ingredient which will form a solid state precipitate is spray cast by atomizing a molten metal stream of the alloy, cooling the droplets in flight so that the particles are either at or near the solidification temperature, and depositing the droplets on a moving collector to generate an alloy having the desired shape. The cooling rate is controlled to maintain the dispersoids as a second phase of a desired size. After casting, the alloy is treated to produce solid state precipitates of the solid state precipitate ingredient in the alloy. The alloy comprises a copper based matrix, a second phase dispersoid uniformly dispersed throughout the matrix and a third phase of a solid state precipitate.

The dispersoids have an average size of about 0.1 micron to about 1.0 micron. The alloy is formed by spray casting the alloy to form droplets. The droplets are cooled at an effective rate to control the size of the second phase dispersoid.

The above-stated objects, features, and advantages of the present invention will become more readily understood in reference to the following detailed description and to the accompanying drawings in which:

DETAILED DESCRIPTION

Figure 1:
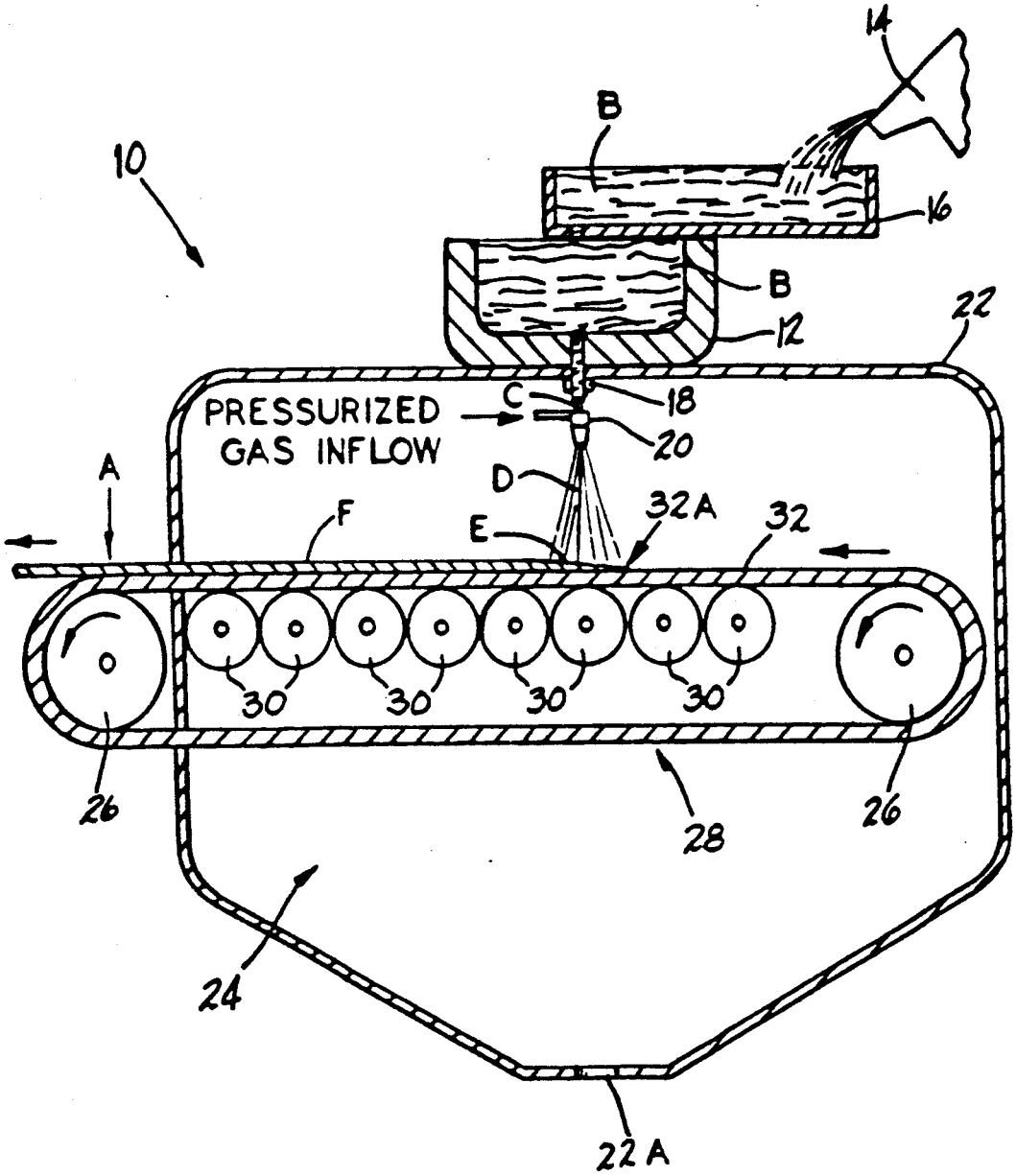
FIG. 1 illustrates a spray deposition apparatus for use in accordance with the process of the present invention.

FIG. 1 illustrates a spray deposition apparatus 10 of the type disclosed in U.S. Pat. Re. Nos. 31,767 and 4,804,034 as well as U.K. Patent No. 2,172,900A, all assigned to Osprey Metals Limited of Neath, Wales. The system as illustrated produces a continuous strip of product A. The manufacture of discrete articles is also possible.

The spray deposition apparatus 10 employs a tundish 12 in which a meal alloy having a desired composition B is held in molten form. The tundish 12 receives the molten alloy B from a tiltable melt furnace 14 via a transfer lauder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas serves to atomize the molten metal alloy and also supplies a protective atmosphere to prevent oxidation of the atomized droplets. The gas should preferably not react with the molten alloy. A most preferred gas is nitrogen. The nitrogen should have a low concentration of oxygen to avoid the formation of oxides. The oxygen concentration is maintained below about 100 ppm and most preferably below about 10 ppm.

The atomization gas is impinged against the molten alloy stream under pressure producing droplets having a mean particle size within a desired range. While the gas pressure required will vary (from about 30 psi to about 150 psi) dependent on the diameters of the molten stream and the atomizing orifices, a gas to metal ratio of from about 0.24 $m^3/kg$ to about 1.0 $m^3/kg$ has been found to produce droplets having a mean diameter of up to about 500 microns. This size range cools at a desired rate to produce copper based alloys with the desired properties as discussed below. More preferably, the mean particle size is from about 50 to about 250 microns.

The atomizer 20 surrounds the molten metal stream C and impinges the gas on the stream C converting the stream into a spray D comprising a plurality of atomized molten droplets. The droplets are broadcast downward from the atomizer 20 in the form of a divergent conical pattern. If desired, more than one atomizer 20 may be used. The atomizer(s) 20 may be moved in a desired pattern for a more uniform distribution of molten metal particles.

A continuous substrate system 24 as employed by the apparatus 10 extends into the spray chamber 22 in generally horizontal fashion and in spaced relation to the gas atomizer 20. The substrate system 24 includes a drive means comprising a pair of spaced rolls 26, an endless belt 28 and a series of rollers 30 which underlie and support an upper run 32 of the endless substrate 28. An area 32A of the substrate upper run 32 directly underlies the divergent pattern of spray D. The area 32A receives a deposit E of the atomized metal particles to form the metal strip product A.

The atomizing gas flowing from the atomizer 20 is much cooler than the molten metal B in the stream C. Thus, the impingement of atomizing gas on the spray particles during flight and the subsequent deposition on the substrate 28 extracts heat from the particles. The metal deposit E is cooled to below the solidus temperature of the alloy B forming a solid strip F which is carried from the spray chamber 22 by the substrate 28.

The droplets striking the collecting surface 28, are preferably in a partially solidified state so that solidification is enacted upon impact with the collector. The collector is positioned at a desired distance below the atomization point at a point where most droplets are partially molten. The droplets are preferably at or near the solidification temperature upon impact.

By controlling the temperature of the molten alloy, the gas volume to metal ratio, the gas flow rate, the temperature of the gas, the collector surface temperature, and the distance between the atomizer and the collector surface, the cooling rate of the droplets may be accurately controlled. When the cooling rate is at an effective rate as discussed hereinbelow, the second phase has a mean particle size of from about 0.1 micron to about 1.0 micron. To inhibit recrystallization, a mean second phase particle size of from about 0.1 micron to about 0.5 micron is believed to be preferred.

The cooling rate of the droplets is selected to be effective to control the growth of the second phase during solidification. For copper based alloys, a cooling rate of greater than about 1° C./second is satisfactory. More preferably, the cooling rate is from about 10° C./second to about 100° C./second.

The cast alloy is formed from a vast multitude of individual droplets having a mean particle size of from about 50 microns to about 250 microns. Each droplet contains a plurality of second phase dispersoids, either formed from the liquid during the initiation of solidification (peritectic decomposition) or during the later part of solidification (eutectic decomposition). The cast strip has a thickness many orders of magnitude greater than the individual droplets. The droplets coalesce to form a coherent strip which comprises a metal matrix having a composition approximately the same as the molten stream and a uniformly dispersed second phase. Because the droplets solidify rapidly, within a few seconds after striking the collector surface, the second phase does not significantly increase in size and the coarse precipitate of conventional casting is avoided.

The parameters required to cool the droplets at an effective rate may be readily determined by experimentation. The parameters are dependent on the specific thermal properties of the alloy selected. For most copper base alloys, the following will form a second phase dispersoid having the desired size and distribution:

a. Melt temperature = 1200° C.
b. Gas pressure = 40–140 psi.
c. Collector surface = copper foil over a ceramic material such as PYREX or PYROTEC, the initial temperature of the collector surface is room temperature.
d. Distance between atomizer and collector = 6 to 24 inches.

The present process is ideally suited for copper alloys which undergo peritectic solidification. During such solidification, the second phase dispersoid appears at the beginning of the solidification. Preferred alloying additions which are desirable for the production for dispersoids according to this invention include iron, cobalt, niobium, and vanadium.

Figure 2:
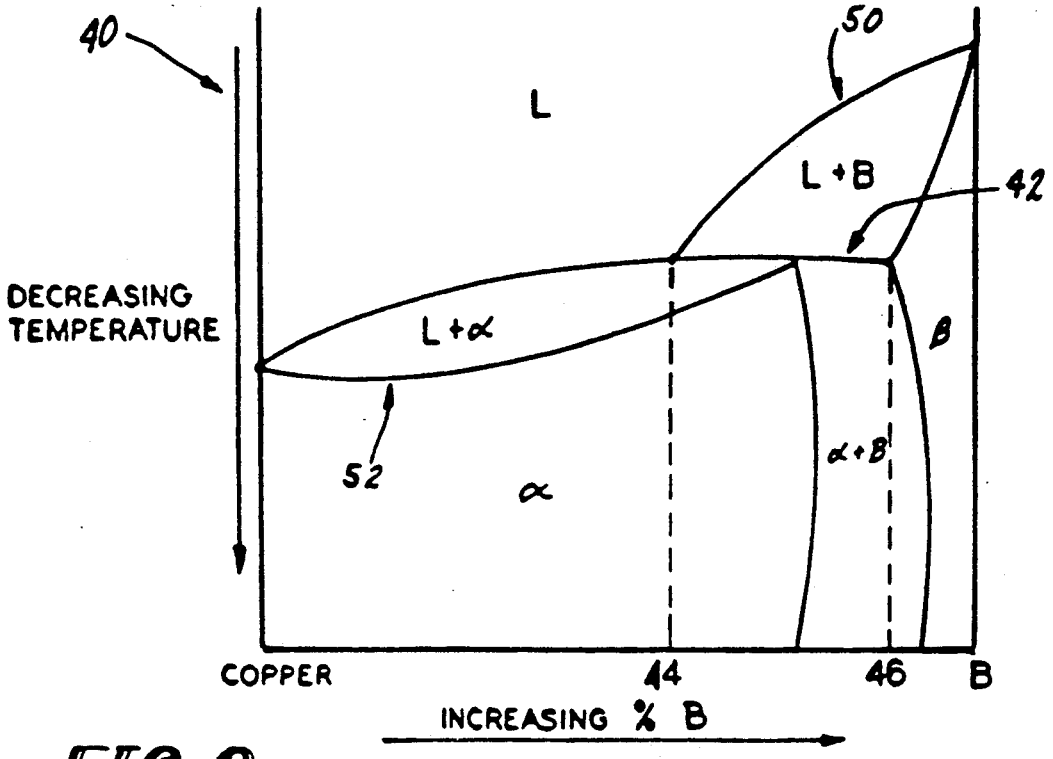
FIG. 2 is a simplified phase diagram of a copper alloy which undergoes peritectic decomposition.

FIG. 2 shows a phase diagram 40 which will be recognized by those skilled in the art as a binary alloy with peritectic solidification. One component of the binary alloy system is copper while the second component may be any alloy which when cast with copper in the proper proportion undergoes peritectic solidification. The peritectic line 42 defines the alloy compositions which undergo a peritectic reaction and is bordered by a maximum copper concentration 44 and a minimum copper concentration 46. The values of the maximum and minimum copper concentrations as well as the peritectic temperature may be obtained from any standard compendum of phase diagrams, for example, pages 293–302 of *Metals Handbook, Eighth Edition* contains phase diagrams for binary copper base ally systems.

By spray casting alloys having a specific composition, a second phase dispersoid with the desired properties may be generated. The effective concentration range is focused around the point 44 which represents the maximum copper concentration from which the B rich second phase will precipitate. The point 44 is also known as the solid solubility point. The concentration of the B component may be from about 100% above the B concentration at point 44 to about 20% below the concentration of the point 44. More preferably, the B concentration is from about 25% above the concentration identified by the point 14 to about 10% below this concentration.

While the minimum concentration required to precipitate the B rich phase is usually thought of as the concentration of B at point 44, such an assumption assumes equilibrium solidification. Due to the rapid cooling rate of spray casting and the finite rate of diffusion, the B phase precipitate forms at B component concentration down to about 20% below the concentration identified by the point 44.

By way of example, for an alloy containing copper and iron, the concentration of iron may be from about 2.0 to about 5.0% by weight.

A binary alloy containing copper and a second component B which may be a single element or a plurality of alloying elements is supplied to the atomizer in the molten state. The temperature of the molten alloy should be significantly above the liquidus line 50. The second phase begins to precipitate at the liquidus line 50. For most copper base alloys, about 1200° C. is sufficiently above the liquidus temperature. The atomized droplets cool very quickly. The $\beta$ phase is rich in the B component of the alloy and somewhat lower in copper than the bulk alloy. In the region between the peritectic line 52 and the solidus 52, the liquid reacts with the $\beta$ phase to form the copper rich $\alpha$ phase. However, since the cooling rate is rapid, decomposition back to $\alpha$ is incomplete and $\beta$ phase dispersoids having a size of between about 0.1 micron and 1.0 micron are frozen in the alloy.

The bulk alloy contains a uniform dispersion of the $\beta$ phase dispersoids throughout the alloy. Once the alloy is cooled below the solidus line 52, no further transformation occurs and the $\beta$ phase remains dispersed through the alloy.

The invention is not limited to copper based alloys which undergo peritectic transformations although such alloys are preferred. Any alloy system which forms a dispersed second phase during solidification may be used.

According to the present invention, the cast alloy also contains an alloying ingredient which will form a third phase solid precipitate when solution treated and age hardened after casting. Alloying ingredients which may be used to produce the solid state precipitate according to the present invention include beryllium, chromium, a combination of nickel and silicon, a combination of nickel and aluminum, magnesium, a combination of magnesium and phosphorus, and a combination of nickel and tin, and mixtures thereof. The range of concentration of such ingredients is thought to be well known in the art. Generally, such ingredients may be present in the alloy in concentrations up to their solid solubility limit. The minimum amount of such ingredients is that below which the ingredients will go into solution when treated. For example, beryllium may be present in the amount of about 2.70% by weight. Nickel and tin for example may be present in the amount ranging from about 4 to 15% by weight nickel and about 4 to about 8% by weight tin. Nickel and silicon may be present with the nickel to silicon ratio being approximately 4:1 with the nickel present in an amount up to about 5.0% by weight.

After the alloy is spray cast in the manner set forth above, the alloy may be treated in a conventional manner to cause the precipitation of the solid state precipitate ingredient. If desired, the cast alloy may be cold rolled to reduce its thickness before the precipitation treatment. Generally, as is well known in the art, precipitation treatment includes solution treating and aged hardening to cause the precipitation of the solid state precipitate. Generally, such treatment involves solution treating at a temperature of about 700° to about 1000° C. for about 10 seconds to one hour followed by aging at a temperature of about 300° to about 500° C. for up to about 24 hours. Between the solution treating and aging and also after the age hardening, the alloy may be cold rolled if desired.

As the method of this invention involves spray casting, it is necessary that porosity in the cast product be eliminated. For this purpose, it is necessary that an alloying addition such as a zirconium, chromium, or titanium be added to eliminate porosity. The amount of such alloying ingredient should be at least 0.05% by weight and may be present up to an amount which would tend to reduce the properties. Preferably, the upper limit is about 0.5%.

By way of example, two alloys having the compositions set forth in Table I below were spray cast according to the following conditions:

a. Melt temperature = 1200° C.
b. Gas pressure = 100 psi.
c. Collector surface = copper foil over a porous ceramic (PYROTEC), the initial temperature of the collector surface at room temperature.
d. Distance between atomizer and collector = 17 inches.

Both sides of the cast alloy were milled to provide a sample of 0.5 inch thickness. The alloys were cold rolled to 0.1 inch and both were solution treated at 1000° for 10 seconds followed by cold rolling to 0.02 inches. Both alloys were then age hardened at 500° C. for two hours followed by cold rolling to 0.014 inches after which they were tested for properties.

TABLE I

| | Mechanical Properties | | | | |
|---|---|---|---|---|---|
| | | | | Bend Properties MBR/T | |
| Alloy | YS | UTS | % E | GW | BW |
| Cu—5 Fe—3 Ni—0.6 Si—0.2 Zr | 96 | 102 | 2.0 | 0.8 | 1.6 |
| Cu—5 Fe—0.2 Zr | 75 | 79 | 2.0 | 0.8 | 1.2 |

As noted in Table I, the yield strength (YS) and ultimate tensile strength (UTS) of the alloy containing the nickel and silicon which formed a solid state precipitate was significantly greater for such alloy than it was for the alloy not having a solid state precipitate. The percent elongation (% E) and the good way (GW) bend properties were generally the same. However, the bad way (BW) bend property for the alloy according to the present invention was improved.

The patents and publications sets forth in the application are intended to be incorporated by reference herein in their entirety.

While the invention has been described above with reference to specific embodiments thereof, it is apparent that any changes, modifications, and variations can be made without departing from the inventive concept disclosed herein. Accordingly, it is intended to embrace all such changes, modifications and variations that fall within the spirit an broad scope of the appended claims. All patent applications, patents and other publications cited herein are incorporated by reference in their entirety.

What is claimed is:

1. A spray case copper base alloy having improved properties comprising:

one or more dispersoid producing first components in an amount of 80–200% of the solid solubility point concentration of the first components in copper;

one ore more solid state precipitates producing second components in an amount less than the solid solubility concentration limit of the second component copper;

and the balance copper;

said alloy having as a structure:

a copper based matrix;

a second phase of dispersions of the first component uniformly dispersed throughout said matrix, said dispersoids having a mean particle size of from about 0.1 micron to about 0.5 micron, said dispersoids being selected from the group consisting of iron, cobalt, niobium, vanadium, and mixtures thereof; and a third phase of a solid state precipitate of the second component.

2. The spray cast alloy of claim 1 wherein said solid state precipitates are selected from the group consisting of beryllium, chromium, a combination of nickel and silicon, a combination of nickel and aluminum, magnesium, a combination of magnesium and phosphorus, and a combination of nickel and tin, and mixtures thereof.

* * * * *